US005664400A

United States Patent [19]

Drury et al.

[11] Patent Number: 5,664,400

[45] Date of Patent: Sep. 9, 1997

[54] CARTON BLANKS HANDLING MECHANISM

[75] Inventors: Timothy H. Drury, Howell; Barry C. Owen, Southfield, both of Mich.

[73] Assignee: Elopak Systems A.G., Glattbrugg, Switzerland

[21] Appl. No.: 644,043

[22] Filed: May 9, 1996

Related U.S. Application Data

[63] Continuation of Ser. No. 389,137, Feb. 15, 1995, abandoned.

[51] Int. Cl.[6] ..... B65B 43/28; B65B 41/06

[52] U.S. Cl. ..... 53/381.1; 53/565; 271/94; 493/313; 493/316

[58] Field of Search ..... 53/565, 564, 566, 53/458, 202; 493/313, 315, 317, 316, 312, 309; 271/94, 95, 10.15, 12, 9.04, 9.07

[56] References Cited

U.S. PATENT DOCUMENTS

| | | | |
|---|---|---|---|
| 3,785,113 | 1/1974 | Martensson et al. | 53/565 |
| 4,269,018 | 5/1981 | Kopp et al. | 53/202 X |
| 4,340,380 | 7/1982 | Calvert | 53/566 X |
| 4,448,008 | 5/1984 | Pankratz et al. | 53/202 |
| 4,566,251 | 1/1986 | Spisak et al. | 53/202 X |
| 4,590,740 | 5/1986 | Rodocker | 53/565 X |
| 4,708,707 | 11/1987 | Koike et al. | 493/313 |
| 4,790,123 | 12/1988 | Ljungstrom et al. | 53/458 |
| 5,180,356 | 1/1993 | Wakabayashi et al. | 493/316 |

*Primary Examiner*—Horace M. Culver

*Attorney, Agent, or Firm*—Reising, Ethington, Barnard & Perry

[57] ABSTRACT

A feeding and loading mechanism for use in pulling carton side-seam-sealed blanks from a magazine, opening same into tubes, and loading the latter onto mandrels of an indexing turret on a liquid-carrying container forming, filling, and sealing machine. The feeding and loading mechanism includes a slidably mounted carrier having at least one vacuum cup mounted at each end thereof aligned with oppositely disposed magazines, a forming shoe fixedly secured between each magazine and adjacent mandrel for opening each tubular flat side-seam-sealed blank into a tube as the blank moves therepast, a loading finger for loading each tube onto the respective mandrel, and a drive assembly operatively connected to the carrier for reciprocally moving same to alternately remove blanks from the oppositely disposed magazines to alternately process same.

10 Claims, 6 Drawing Sheets

CARTON BLANKS HANDLING MECHANISM

This is a Continuation of application Ser. No. 08/389,137, filed Feb. 15, 1995 and now abandoned.

TECHNICAL FIELD

This invention relates generally to carton forming, filling and sealing machines and, more particularly, to mechanisms for feeding and opening carton blanks into four-sided tubes, and loading same onto the mandrels of dual line machines.

BACKGROUND ART

Heretofore, either dual drive arrangements have been required for separate loading mechanisms to load carton tubes onto the mandrels of dual line machines, or dual loading mechanisms are driven simultaneously for the dual lines.

U.S. Pat. No. 4,448,008 discloses a forming, filling, and sealing machine including two conveyors, two turrets, with each turret having a plurality of dual mandrels, and two loading units for each turret, all operating simultaneously. Each loading unit comprises a drive chain with tube-pushing fingers.

U.S. Pat. No. 4,790,123 discloses two dual mandrel wheels, cooperating with two double feeders.

DISCLOSURE OF THE INVENTION

A general object of the invention is to provide an improved feeding and loading arrangement for feeding and opening carton blanks into tubes, and loading the latter onto the mandrels of a dual line carton forming, filling, and sealing machine.

Another object of the invention is to provide such a feeding and loading arrangement having a single drive mechanism.

A further object of the invention is to provide a feeding and loading arrangement for alternately feeding and opening pairs of carton blanks into tubes, and loading the tubes onto pairs of mandrels on each of dual turrets on a carton forming, filling, and sealing machine, and having a single drive mechanism therefor.

Still another object of the invention is to provide a feeding and loading mechanism for use in conjunction with mandrels of a dual turret carton forming, filling and sealing machine, and including a slidably mounted carrier having at least one vacuum cup mounted at each end thereof aligned with oppositely disposed magazines, a forming shoe fixedly secured between each magazine and an adjacent mandrel of one of the turrets for opening each flat carton blank into a tube as the blank moves therepast, a loading finger for loading each tube onto the mandrel, and a drive assembly operatively connected to the carrier for reciprocally moving same to alternately remove blanks from the oppositely disposed magazines to alternately process same.

A still further object of the invention is to provide such an arrangement for use in conjunction with oppositely disposed pairs of side-by-side magazines and side-by-side mandrels.

These and other object and advantages will become more apparent when reference is made to the following drawings and the accompanying description.

BEST MODE OF CARRYING OUT THE INVENTION

Figure 1A:
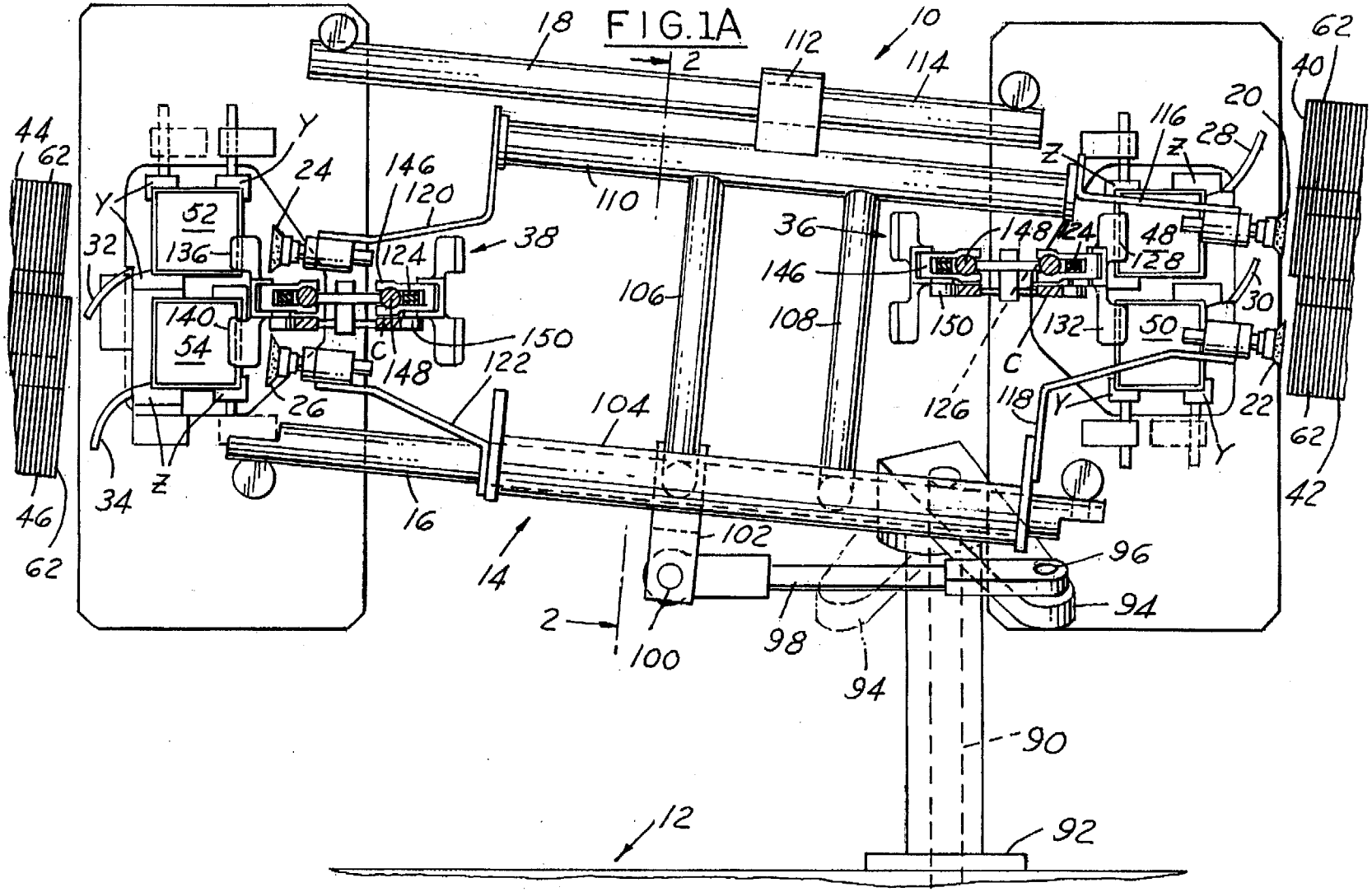
FIGS. 1A and 1B are end views of a feeding and loading mechanism embodying the invention.
Figure 1B:
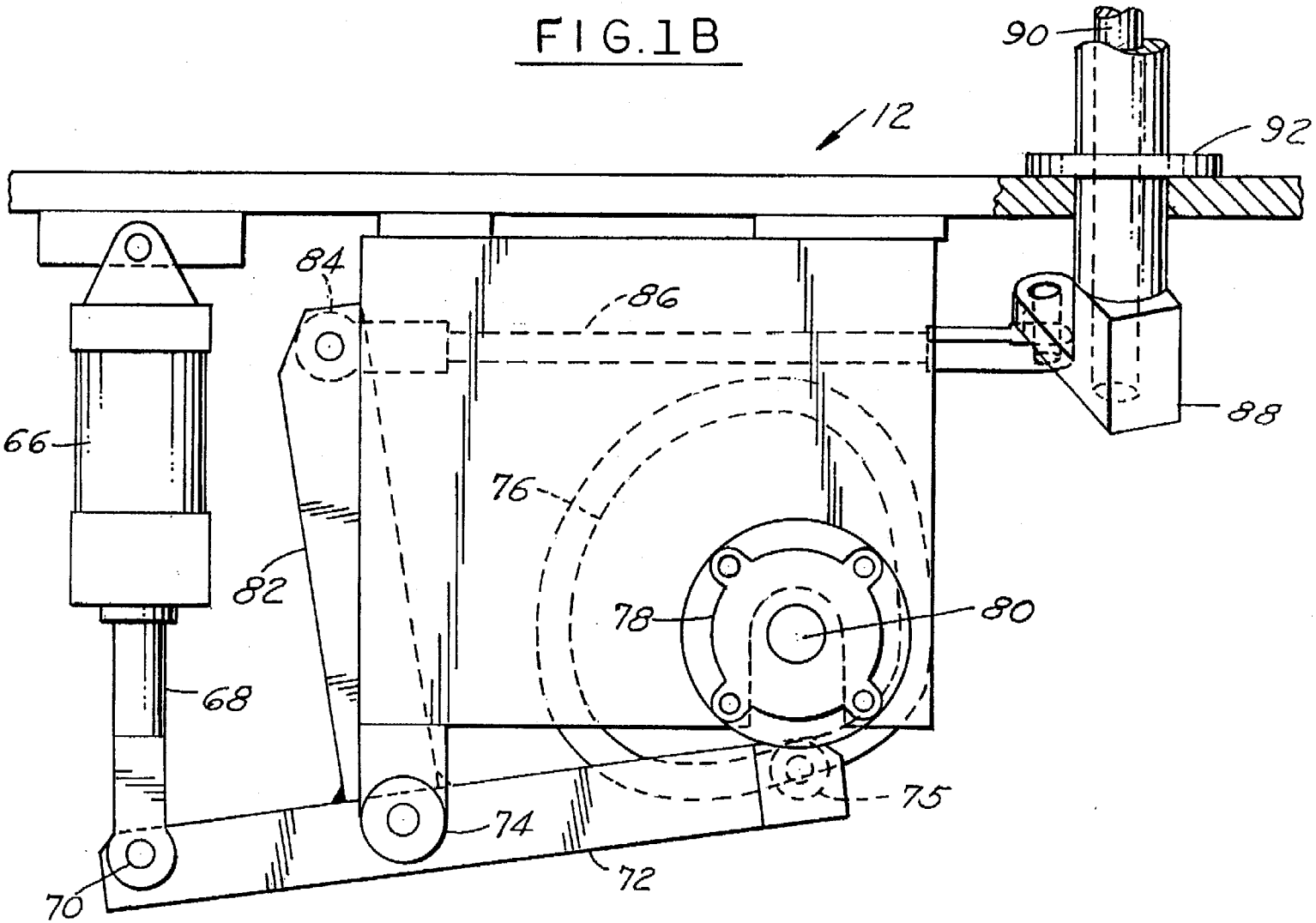
Figure 2:
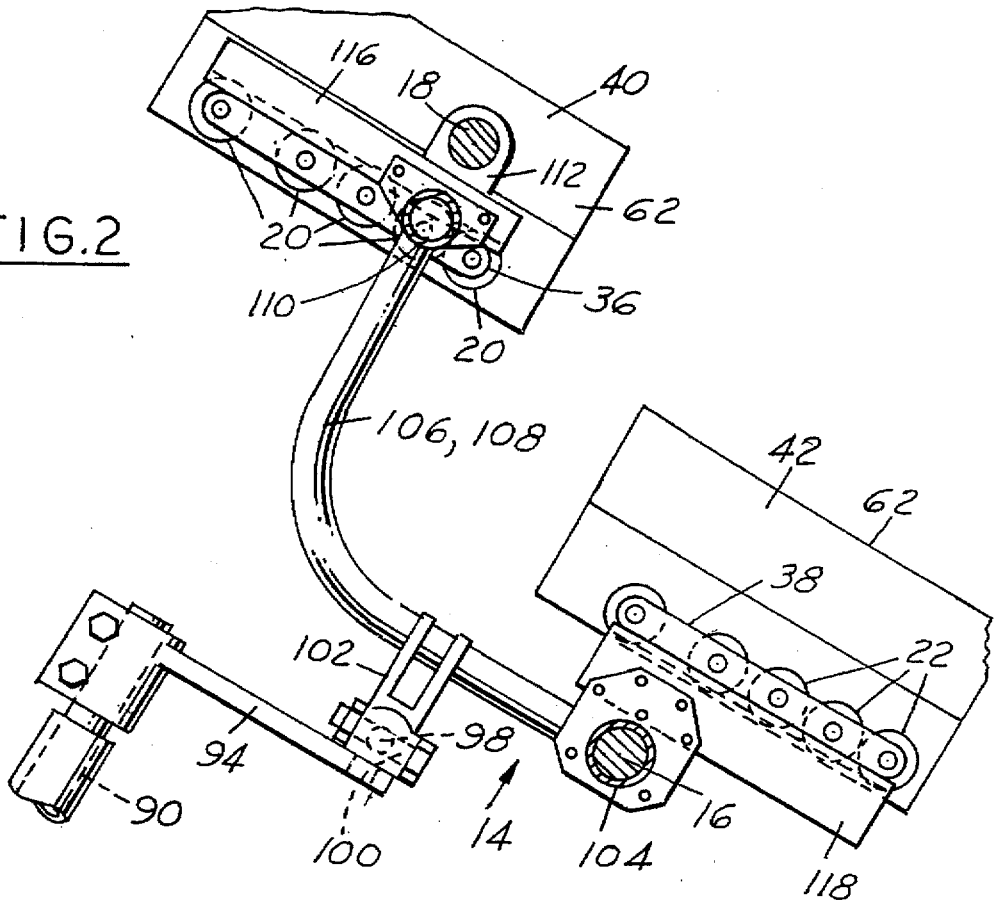
FIG. 2 is a cross-sectional view taken along the plane of the line 2—2 of FIG. 1A, and looking in the direction of the arrows.

Referring now to the drawings in greater detail, FIGS. 1A and 1B illustrate a feeding and loading mechanism 10 including generally a single drive unit 12, a carrier 14 reciprocally driven on guide rods 16 and 18 by the drive unit 12, pairs of sets of vacuum cups 20, 22 and 24, 26 (FIGS. 1A and 2) mounted on opposite ends of the carrier 14 for reciprocal movement therewith, pairs of forming shoes 28, 30 and 32, 34 fixedly secured adjacent the paths of the pairs of sets of vacuum cups 20, 22 and 24, 26, respectively, and a pair of loading units 36 and 38 (FIGS. 1A and 7) mounted for operation at the inner ends of the respective paths of the vacuum cups 20, 22 and 24, 26.

Figure 5:
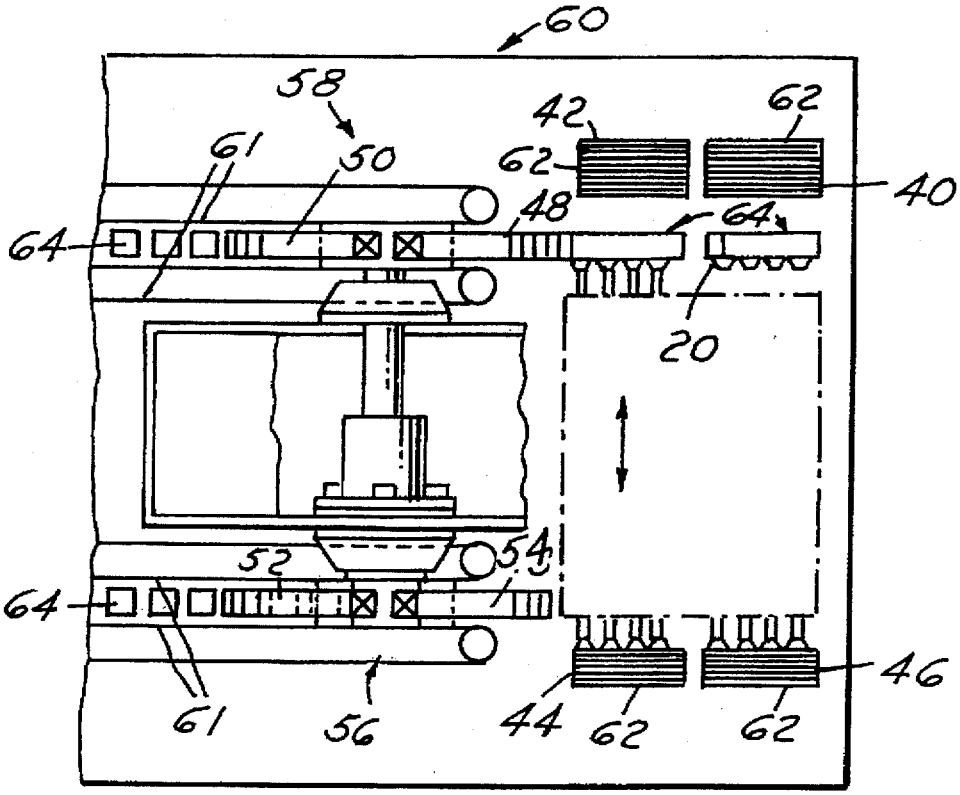
FIG. 5 is a fragmentary plan view of a dual turret, dual mandrel forming, filling, and sealing machine on which the FIG. 1A structure is operative.

The reciprocal movement of the sets of vacuum cups 20, 22 and 24, 26 is between two oppositely disposed pairs of magazines 40, 42 and 44, 46 and oppositely disposed pairs of mandrels 48, 50 and 52, 54 of respective turrets 56 and 58 of a forming, filling and sealing machine 60 including two asynchronously driven double indexing conveyors 61 (FIG. 5).

Figure 3:
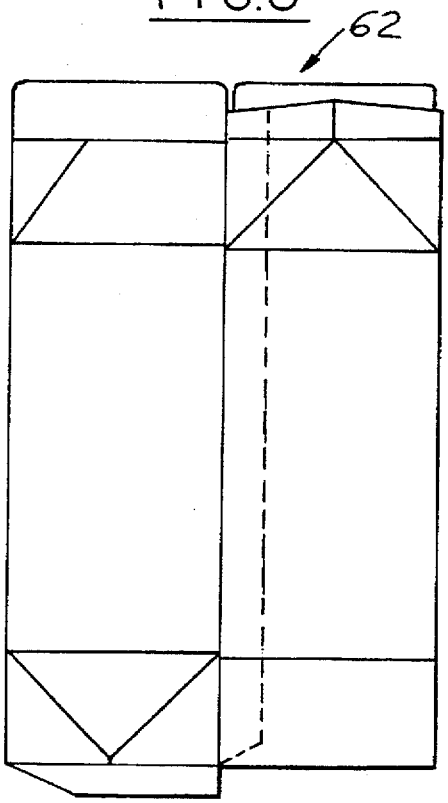
FIG. 3 is a side elevational view of a flat, folded and side-seam-sealed blank to be processed by the FIG. 1 structure.
Figure 4:
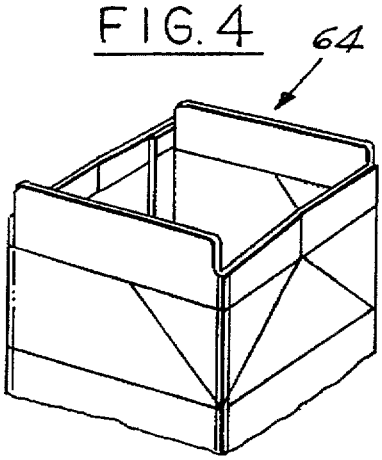
FIG. 4 is a view of the blank of FIG. 3 opened into an operational tubular configuration.

The magazines 40, 42 and 44, 46 hold flat side-seam-sealed blanks 62 (FIG. 3) to be opened by the forming shoes 28, 30 and 32, 34 into four-sided tubes 64 (FIG. 4), and loaded as such onto the pairs of mandrels 48, 50 and 52, 54, as will be explained.

More specifically, the drive unit 12 (FIG. 1B) includes an air cylinder 66 having a piston rod 68 pivotally secured at the distal end thereof by a suitable ball connection 70 to one end of a rocker arm 72. The latter rocker arm 72 is pivotally mounted on a rocker arm shaft 74 at an intermediate point therealong, with the other end of the rocker arm 72 having a cam roller 75 in rolling engagement with a cam 76. The cam 76, having a predetermined camming surface, is rotatably mounted on a shaft 80, through a hub 78, and driven by a motor (not shown).

A second arm 82 is secured at one end thereof to the rocker arm 72 at an intermediate location therealong. The other end of the arm 82 is connected by a pivot 84 to one end of a rod 86. The other end of the rod 86 is pivotally connected to one end of a lever 88. The other end of the lever 88 is secured to one end of a shaft 90 mounted for rotation through a fixed bearing 92. As shown in FIG. 1A, the other end of the shaft 90 is secured to one end of a lever 94. The other end of the lever 94 is pivotally connected by a pivot 96 to one end of a rod 98. The other end of the rod 98 is pivotally connected by a pivot 100 to one end of an arm 102. The other end of the arm 102 is secured to a tube 104 of the carrier 14 which tube is slidably mounted on the rod 16.

A pair of parallel cross braces 106 and 108 (FIG. 2) of a predetermined shape, are connected between the tube 104 and a support member 110 parallel to the tube 104. A block member 112 is secured to the support member 110, and slidably mounted around the fixed rod 18 (FIG. 1A). Four brackets 116, 118, 120 and 122 are secured to respective ends of the tube 104 and the support member 110. The brackets 116, 118, 120 and 122 serve to support the respective sets of vacuum cups 20, 22, 24 and 26.

Figure 7:
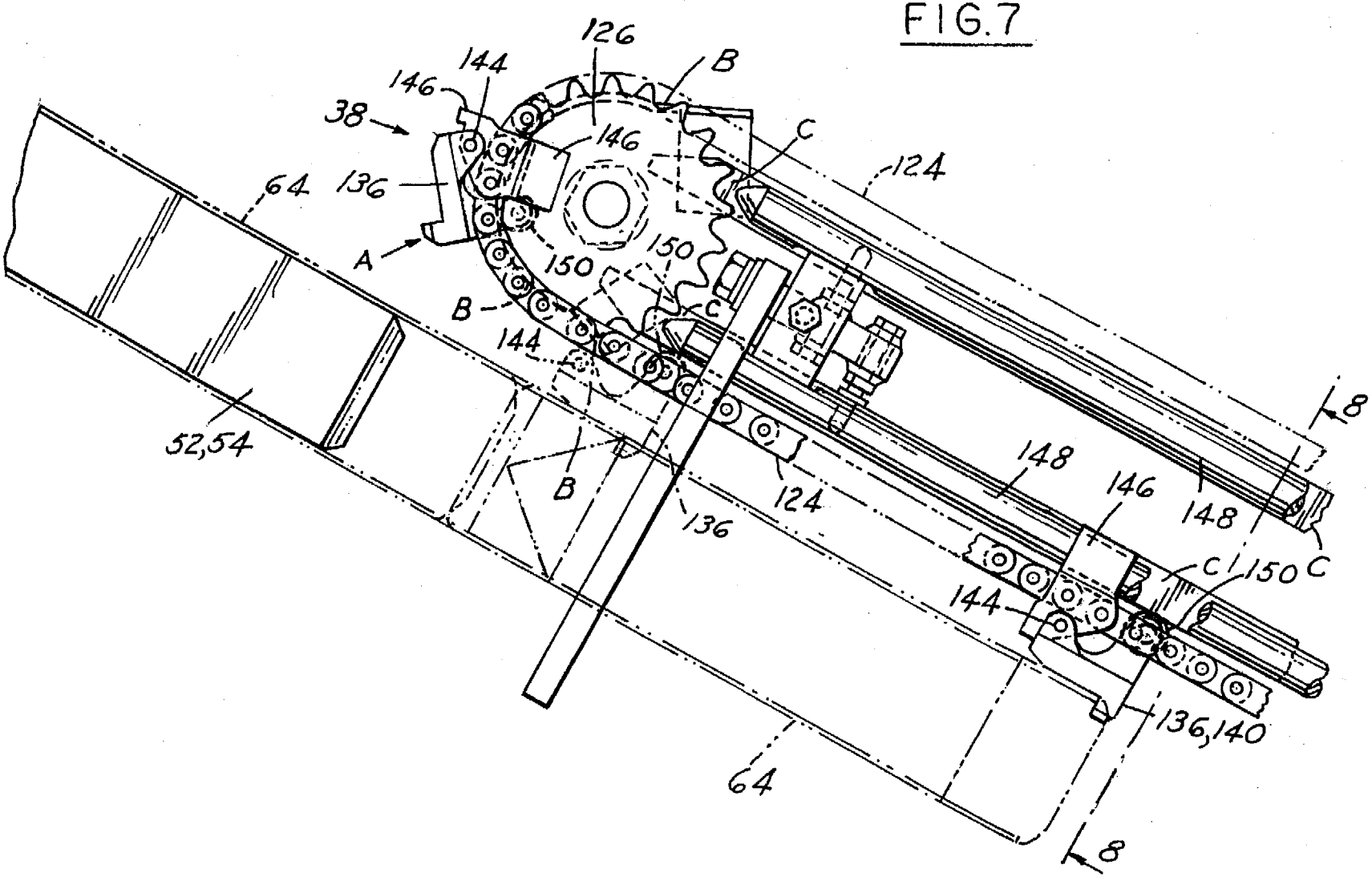
FIG. 7 is a fragmentary view taken in the direction of the arrows 7—7 of FIG. 6.
Figure 8:
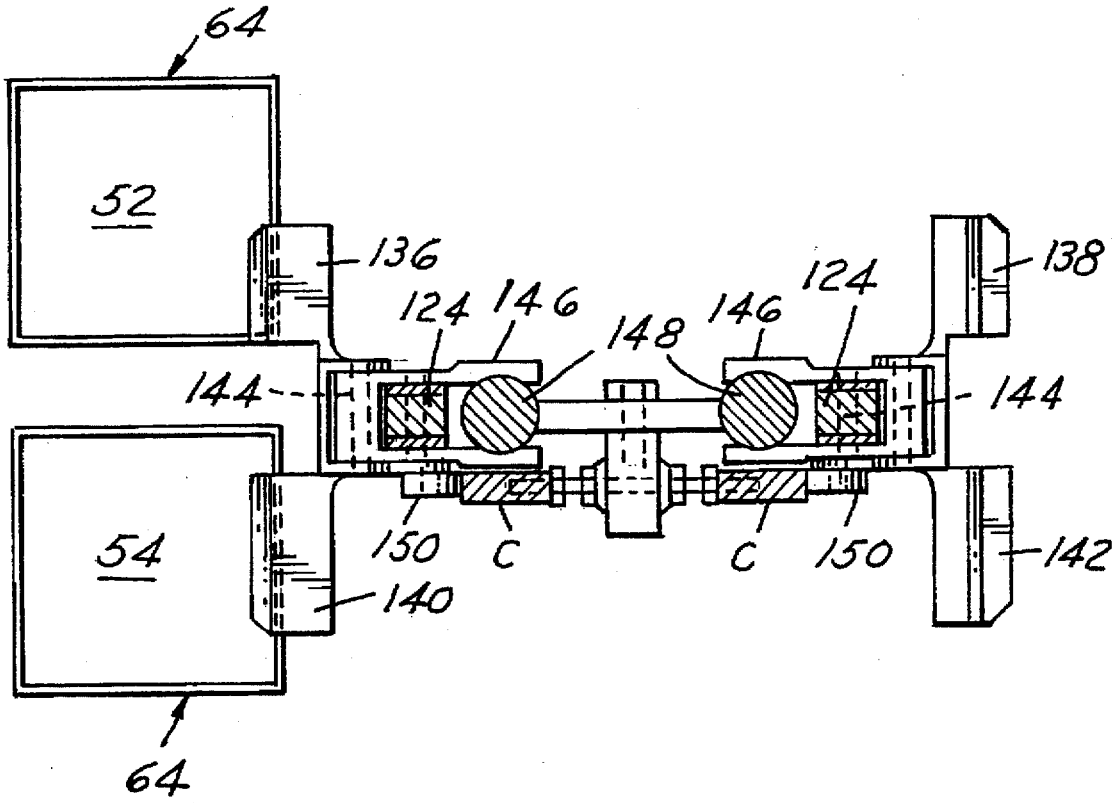
FIG. 8 is a cross-sectional view taken along the plane of the line 8—8 of FIG. 7, and looking in the direction of the arrows.

The two loading units 36 and 38 (FIGS. 1A and 7) include respective chain drives, represented at 124, for continuous or indexed rotation, the chain drives being mounted around sprockets 126, a predetermined distance from the distal ends of the respective pairs of mandrels 48, 50 and 52, 54. The units 36 and 38 each include a series of pairs of upper and lower loading fingers 128, 132 at the right in FIG. 1A, and 136, 140 at the left in FIG. 1A. As shown in FIGS. 7 and 8, and apparent from the stepped positions of the carton tubes 64 in FIG. 6, the two chain drives 124 serve to drive the respective double loading fingers in engagement with respective bottom edges of the tubes 64, to load the latter onto the respective mandrels. Firstly, the lower loading finger of a pair engages the lower carton tube of a pair advances it until the upper loading finger of the pair engages the upper carton tube, whereupon the two fingers advance both cartons until the fingers begin to turn around the associated sprocket 126. Each loading finger is pivotally mounted on a pivot pin 144 on a bracket 146 connected to the chain drive 124 and slidably mounted on rods 148, and has a roller 150 rotatably mounted on an inner end thereof for the purpose of retracting the carton-engaging portion A of the loading finger (FIG. 7). This is accomplished by the roller 150 contacting a guide B, which controls the position of the roller, and in turn, the finger while the roller 150 can no longer roll upon guides C. The roller 150 rides on one of the guides C during the carton tube loading phase.

The two pairs of fixedly secured forming shoes 28, 30 and 32, 34 are positioned adjacent the outlet ends of the respective magazines 40, 42, 44 and 46. Each shoe is a substantially arcuate shaped wall, serving to open the side-seam-sealed blanks 62 into the four-sided tubes 64 (FIG. 4), as will be explained.

In operation, the drive assembly 12, through its co-operating components described above, moves the carrier 14 back and forth (FIGS. 1A and 5) along the two rods 16 and 18. With the movement to the right in FIG. 1A, the sets of vacuum cups 20 and 22 simultaneously engage the outermost pair of flat carton blanks 62 in the respective magazines 40 and 42, to pull them toward and into engagement with the respective forming shoes 28 and 30, as the carrier 14 returns toward the left in FIG. 1A.

Figure 6:
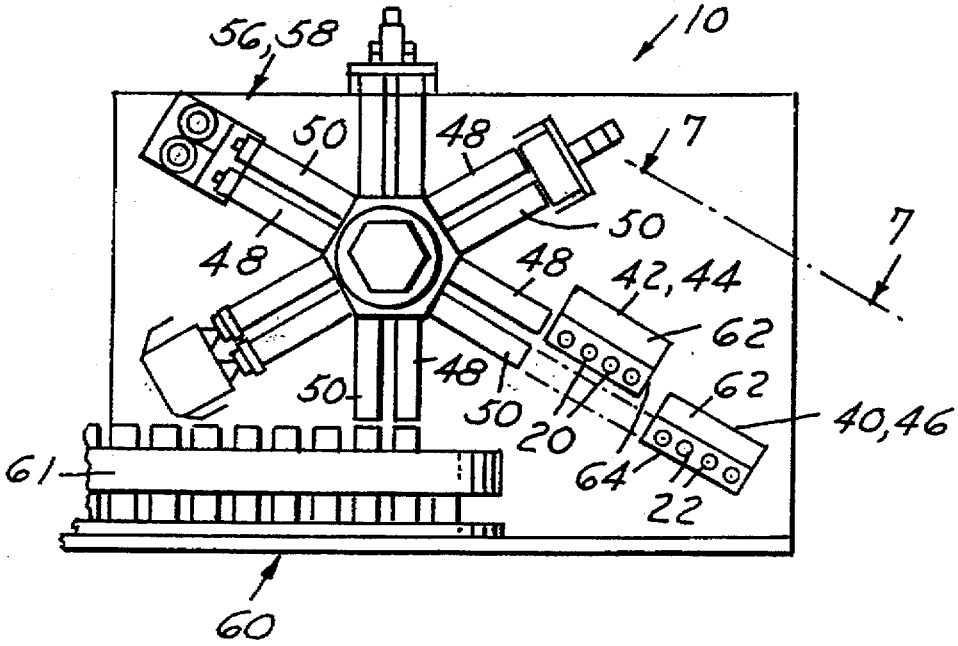
FIG. 6 is a fragmentary side elevational view of the FIG. 5 machine.

Movement of the flat blanks 62 (FIG. 3) into engagement with and across the surfaces of the forming shoes 28 and 30 (FIG. 1A) serves to cause the individual flat, side-seam-sealed blanks 62 to progressively open into the four-sided, open-ended tubes 64 (FIG. 4), while being retained at one of the four sides thereof by the sets of vacuum cups 20 and 22 and pulled into positions adjacent and axially aligned with the distal ends of the respective mandrels 48 and 50, but in stepped relationship, as shown in FIG. 6. The respective dwell periods of the carrier 14 and the mandrels 48 and 50 are co-ordinated to accomplish the axial alignment arrangement.

After forming the carton blanks 62 into four-sided shape, they are maintained square by (2 or more) carton guides Z and Y (FIG. 1A) during the loading onto the mandrels.

Once aligned in the above described manner, the lower finger 132 of one of the pairs of loading fingers 128 and 132 of the continuously rotating loading unit 36 engages the bottom edge of the lower carton tube and advances that carton tube towards the mandrel 50 until the upper finger 128 of that loading finger pair engages the bottom edge of the upper carton tube whereupon the pair of fingers advances both tubes to push them axially onto the respective mandrels 48 and 50 for transfer by the indexing turret 58 to the next processing station. As is well known, the stations that follow include pre-breaking, heating, folding and sealing of the bottom closure panels on the mandrels. Thereafter, the bottom sealed cartons are transferred to conveyors, along which they are filled, and the top panels heated, folded and sealed.

During the above described movement of the sets of vacuum cups 20 and 22, the other sets of vacuum cups 24 and 26 have been moved leftwardly in FIG. 1 by the carrier 14, into engagement with the exposed flat blanks 62 in the magazines 44 and 46. The cycle continues for forming the blanks 62 via the sets of vacuum cups 24 and 26, the forming shoes 32 and 34, and loading the tubes 64 via the other loading unit 38 onto the mandrels 52 and 54 in the manner described above relative to the mandrels 48 and 50, to be indexed by the second turret 56 to the next processing station.

INDUSTRIAL APPLICABILITY

It should be apparent that the invention provides a compact and efficient mechanism for alternately pulling flat, side-seam-sealed blanks from oppositely disposed magazines, opening same into tubes, loading the tubes onto asynchronously driven adjacent mandrels on carton forming, filling and sealing machines, with the mechanism being driven by a single drive assembly.

It should be further apparent that the mechanism is adaptable for use on either single radially extending mandrels on parallel turrets of a dual line carton forming, filling and sealing machine, or to side-by-side pairs of mandrels (FIG. 6) on each of parallel turrets of a dual line carton forming, filling and sealing machine (FIG. 5).

While but one embodiment of the invention has been shown and described, other modifications are possible within the scope of the following claims.

What is claimed is:

1. A carton blanks handling mechanism, comprising feeding and opening means for feeding tubular, flat, carton blanks from first and second oppositely disposed magazines and for opening the blanks, said feeding and opening means including a oscillatorily mounted carrier having at respective ends thereof first and second blanks-seizing devices for alignment with the respective magazines, driving means operatively connected to said carrier for oscillating the same, and fixedly secured rod means having said carrier slidably mounted thereon.

2. A mechanism according to claim 1, wherein said feeding and opening means further includes, in the regions of the respective ends of the carrier, first and second forming shoes arranged to co-operate with the respective blank-seizing devices to open the blanks.

3. A mechanism according to claim 1, and further comprising loading means for loading opened blanks, fed alternately from the respective magazines, onto respective first and second mandrels, alternately.

4. A mechanism according to claim 3, wherein said loading means comprises first and second loading fingers mounted separately from said carrier.

5. A mechanism according to claim 4, wherein said loading means further comprises first and second chain drives having said first and second loading fingers respectively mounted thereon.

6. A mechanism according to claim 1, wherein said feeding and opening means also serves to feed tubular, flat carton blanks from third and fourth magazines disposed opposite each other but adjacent the first and second magazines, respectively, and to open these blanks, and wherein said carrier has at respective ends thereof third and fourth blank-seizing devices for alignment with the respective third and fourth magazines.

7. A mechanism according to claims 6, and further comprising loading means for loading opened blanks, fed alternately from the first and third magazines and from the second and fourth magazines, onto respective mandrels.

8. A mechanism according to claim 7, wherein said loading means comprises first, second, third and fourth loading fingers mounted separately from the carrier.

9. A mechanism according to claim 8, wherein said loading means includes a first chain drive mounting said first and third loading fingers for loading carton blanks forwarded by the first and third blank-seizing devices, and a second chain drive mounting said second and fourth loading fingers for loading carton blanks forwarded by the second and fourth blank-seizing devices.

10. A mechanism according to claim 1, wherein said driving means includes first lever means pivotally connected to said carrier, a shaft fixedly secured to said lever means, second lever means pivotally fixed to said shaft, cam and follower means for oscillating said second lever means, and means for rotating said cam and follower means one relative to the other.

* * * * *